United States Patent [19]

Martens

[11] Patent Number: 4,968,236

[45] Date of Patent: Nov. 6, 1990

[54] AUXILIARY AUGER ASSEMBLY FOR HOLLOW CORE SLAB PRODUCTION

[75] Inventor: Ernest Martens, Winnipeg, Canada

[73] Assignee: Ultra Span - a division of Alphair Ventilating Systems Inc., Winnipeg, Canada

[21] Appl. No.: 375,879

[22] Filed: Jul. 6, 1989

[51] Int. Cl.[5] ..... B28B 1/10; B28B 1/30

[52] U.S. Cl. ..... 425/64; 425/204; 425/208; 425/262; 425/381; 425/427

[58] Field of Search ..... 425/64, 204, 208, 209, 425/381, 206, 262, 426, 427; 366/81

[56] References Cited

U.S. PATENT DOCUMENTS

| | | | |
|---|---|---|---|
| 3,159,898 | 12/1964 | Van Name | 425/64 |
| 3,227,293 | 1/1966 | Poutsch | 425/64 |
| 3,284,867 | 11/1966 | Booth | 425/64 |
| 3,605,217 | 9/1971 | Martens et al. | 425/64 |
| 3,781,154 | 12/1973 | Herbert et al. | 425/64 |
| 3,994,639 | 11/1976 | Hewitt | 425/64 |
| 4,022,556 | 5/1977 | Goetjen | 425/64 |
| 4,046,848 | 9/1977 | Putti | 264/70 |
| 4,067,676 | 1/1978 | Hewitt | 425/64 |
| 4,074,803 | 2/1978 | Kollberg | 425/208 |
| 4,132,845 | 1/1979 | Covington, Jr. et al. | 425/208 |
| 4,533,310 | 8/1985 | Spinner | 425/208 |
| 4,548,565 | 10/1985 | Bunn | 425/64 |
| 4,632,795 | 12/1986 | Haber et al. | 425/208 |
| 4,755,338 | 7/1988 | Hasala | 425/64 |

FOREIGN PATENT DOCUMENTS

| | | | |
|---|---|---|---|
| 1952306 | 6/1970 | Fed. Rep. of Germany | 425/204 |
| 58-36425 | 3/1983 | Japan | 425/204 |
| 629110 | 9/1949 | United Kingdom | 425/204 |

*Primary Examiner*—Jay H. Woo
*Assistant Examiner*—Khanh P. Nguyen
*Attorney, Agent, or Firm*—Irell & Manella

[57] ABSTRACT

Auxiliary or stub augers are used in conjunction with a convention auger machine that is used to form reinforced hollow cored slabs. They can be used to ensure consolidation of concrete above the cores particularly and relatively in large diameter slabs or can be substituted for one or more of the conventional core forming augers if a core or bore is not required in the slab at that location. The stub auger consists of a first portion having a non tapering shaft and a non tapering flight thereon. The second or downstream portion has a gradually reducing diameter shaft with the flight which continues from the flight around the first portion, decreasing in diameter to substantially zero at the extreme downstream end of the shaft.

19 Claims, 4 Drawing Sheets

AUXILIARY AUGER ASSEMBLY FOR HOLLOW CORE SLAB PRODUCTION

This invention relates to new and useful improvements in the formation of hollow core slabs, particularly slabs having a relatively deep cross section in the neighborhood of sixteen inches.

Building codes in certain countries require that such slabs have cores of a substantially rectangular cross section and these are formed in a standard hollow core forming machine such as that illustrated and described in U.S. Pat. No. 3,159,898, Ellis et al., U.S. Pat. No. 3,284,867, Booth, and U.S. Pat. No. 3,781,154, Herbert et al.

In the past several years, hollowcore technology has introduced new slabs with thicker dimensions (larger cross sectional area) to obtain a slab that can span longer lengths and carry larger load capacities for uses in parkades, large terminals and larger buildings. The building codes require a slab that is light, yet handles these extended spans and loads.

At the present time, there are some extruders that product 40 cm (16 inch) slabs with four cores using four conventional augers. The difficulty in this situation is that a large area above the conventional augers must be filled with concrete mix and pushed over the "hump" of the forming mandrel. Because of the limited volume of mix that a conventional auger can deliver, the concrete has a tendency to be pushed back over the auger and not over the forming mandrel. This causes starvation on the upper portion of the slab resulting in poor density and a lower load capacity.

The present invention overcomes the disadvantages of conventional core technology by providing what is defined as a "stub auger" situated above the conventional auger. This stub auger has a capacity to fill the void in the upper portion of the slab and to compress the concrete mix to a satisfactory density which in conjunction with a conventional hammering plate, results in an even density and stronger slab.

Another advantage and use of such stub augers is to selectively install one or more stub augers in place of the existing augers in order to fill one or more hollow cores to achieve specific load criteria. The common method used to achieve this is to make several openings in the slab, while it is green, above a specific core and then fill the core through the openings with a slump mix. This filled core then dries and shrinks, usually more than the surrounding slab because it is not compressed, and does not bond satisfactorily with the surrounding slab material in order to form a solid section.

By using a stub auger in that specific core location rather than of the conventional auger, the void at that location in the hollow core slab is filled and the filled hole becomes integral with the rest of the extruded slab.

If it is desired to produce a solid slab without any hollow core characteristics, then all of the standard augers are removed together with forming mandrels and follower tubes and a stub auger is used instead at each of the core locations in order to compact the concrete mix and provide the necessary extrusion action. Under these circumstances a solid slab is obtained rather than a hollow core slab.

The stub augers are easily mounted and demounted and secured to the bearing supports and drive means in a manner similar to conventional augers.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention in which:

DESCRIPTION OF THE DRAWINGS

In the drawings like characters of reference indicate corresponding parts in the different figures.

DETAILED DESCRIPTION

Figure 3:
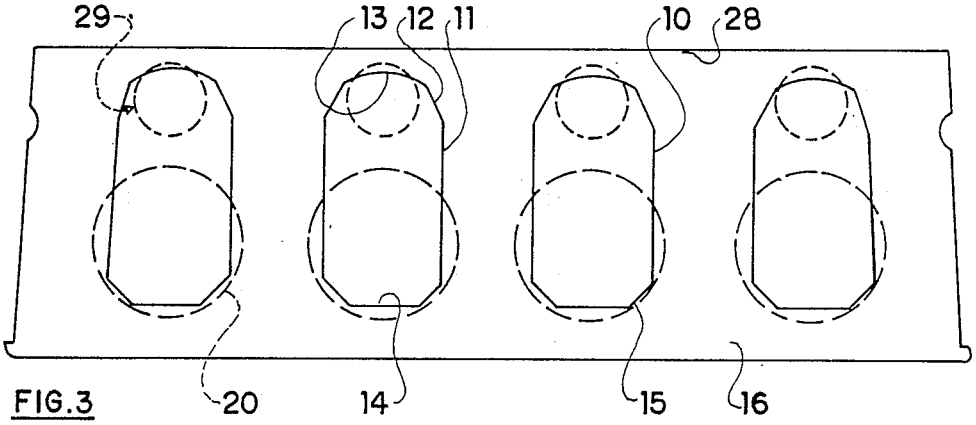
FIG. 3 is an end view of a relatively large dimensioned slab showing in phantom, the location of the conventional core forming augers and the stub augers for filling the large area above the conventional augers.

Proceeding therefore to describe the invention in detail, reference should first be made to FIG. 3 which shows one embodiment of the relatively large cross sectioned slabs having a depth of sixteen inches or more.

This slab is provided with four hollow core longitudinally extending apertures 10 which are substantially rectangular when viewed in end elevation and include substantially vertical sides 11 inclined upper wall portions 12 and a wived upper invention wall 13.

The base of the cores include a horizontal base wall 14 and inclined walls 15 extending from the ends of the base 14 to the lower ends of the vertical walls 11. However these cross sectional configurations are exemplary only as is the number of cores illustrated, namely, four.

Figure 4:
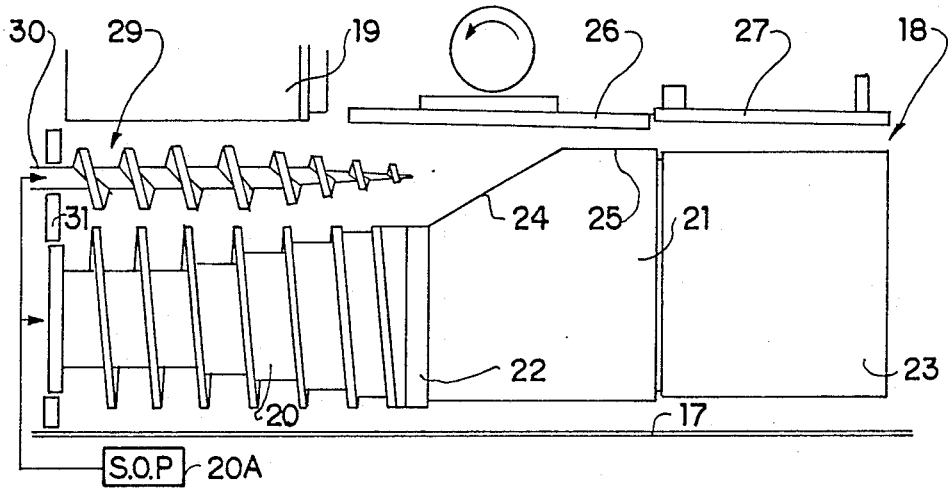
FIG. 4 is a schematic side elevation of the core forming machine with the stub augers in place.

The slab 16 is formed by a conventional core forming machine described in the above mentioned patents and includes a floor 17 upon which the slab is formed. The machine shown schematically and collectively designated 18 includes a hopper 19. The main conventional core forming auger 20 (one for each core aperture) which is rotated by a source of power (shown schematically in FIG. 4 at 20A) and receives concrete from the hopper, compresses same and extrudes same behind the machine with the machine being moved forwardly along rails (not illustrated) by the resistance of the formed core on the floor 17.

A stationary forming tube or mandrel 21 is situated upon the end 22 of the main auger and a stationary follower tube 23 is situated behind the forming tube in order to finish the interiors of the cores 10 as the mass is extruded thereby.

In order to produce the configuration of the cores illustrated, for example, in FIG. 3, the forming tube includes an upwardly inclining ramped surface 24 upon the upper side thereof which leads up to the upper horizontal surface 25 which may be arcuately curved transversely to form the curved upper wall 13 of the bores or cores 10.

Because of the increased height of the cores, the use of the conventional auger 20 causes some difficulty in that this large area must be filled with concrete mix and then pushed over the hump or up the ramp 24 to the area between the hammering plate 26 and the troweling plate 27 which forms the upper surface 28 of the finished slab and a lack of material flow in certain of these areas may cause starvation in that area thus making it impossible to consistently extrude an acceptable product with the necessary strength characteristics. In fact, slumping sometimes occurs in the area above the bores.

Figure 5:
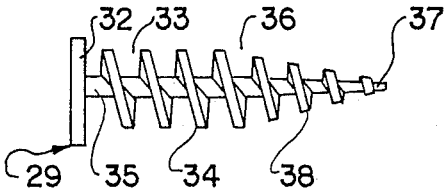
FIG. 5 is a side elevation of a "mounting flange" type of stub auger.
Figure 6:
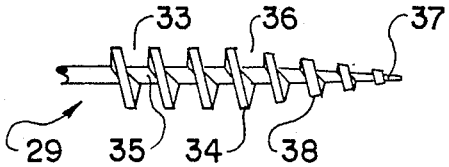
FIG. 6 is a side elevation of a "straight shaft" type of stub auger.
Figure 10:
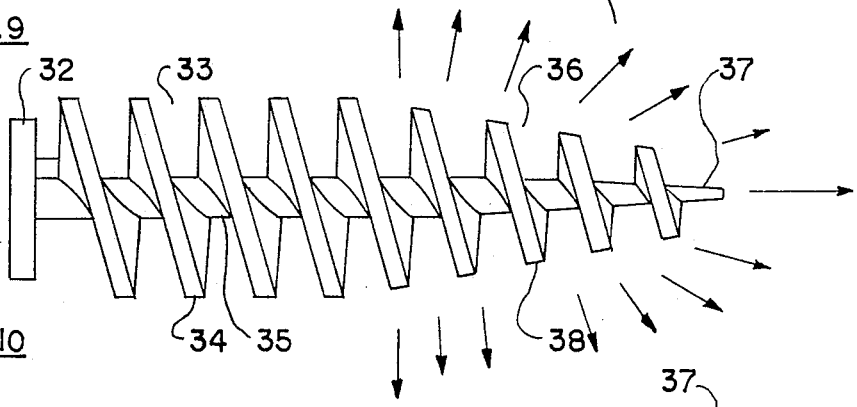
FIG. 10 is an enlarged view of FIG. 3 showing details of construction of this particular embodiment.
Figure 11:
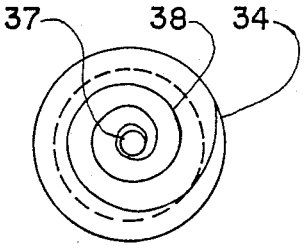
FIG. 11 is an end view taken from the right hand side of FIG. 3.

One use of the present invention overcomes this disadvantage by providing a stub auger collectively designated 29 which is situated above the conventional auger 20 and is rotated from the source of power by chain drive or any other conventional and well known method. These stub augers are situated one over each of the conventional augers and are supported in a cantilever fashion by the inner ends 30 thereof in a conventional manner within bearings (not illustrated) in front of the wall or barrier 31 of the machine These stub augers may include a mounting flange 32 as shown in FIG. 5 and 10 or may be a "straight shaft" type auger as shown in FIG. 6.

In either case, the front portion 33 of the stub auger is provided with a flight 34 surrounding a shaft 35 with the shaft having a constant diameter and the flighting also having a constant diameter and constant pitch.

The rearward portion 36 of the stub auger has a shaft which may taper towards the rear end 37 thereof and is provided with a flighting 38 as a continuation of flighting 34, which is also provided with a constant pitch but with a diameter which reduces as it approaches the end 37.

This is situated immediately above the conventional auger and below the hopper 19 and has the capacity to fill the void in the upper portion of the slab and to assist in forcing same over the ramped portion 24 of the forming tube or mandrel thus resulting in an even density of concrete and consequently a much stronger slab. The conventional hammering plate consolidates and compresses the concrete between the plate and the forming tube and the trowelling plate 27 smooths and finally dimensions the area between the trowelling plate and the follower tube.

Figure 1:
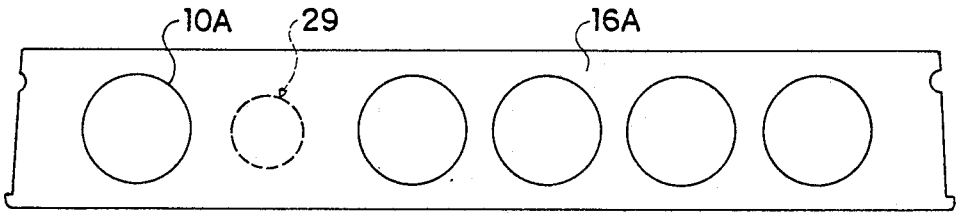
FIG. 1 is an end view of a cored slab showing the location of a stub auger in order to eliminate one of the hollow core apertures.

FIG. 1 shows the stub auger 29 in the schematic form situated in place of a conventional auger, forming mandrel and follower tube thus filling in the location where the core would normally be formed. In other words, the stub auger prevents the formation of a hollow core at this location and replaces the void with a concrete mix which is part of the overall concrete mix forming the slab thus giving a consolidated concrete mix to this area.

The mounting of the stub auger is similar to the mounting of the conventional auger be it a mounting flange type as shown in FIG. 5 or a "straight shaft" type depending upon design parameters.

Figure 2:
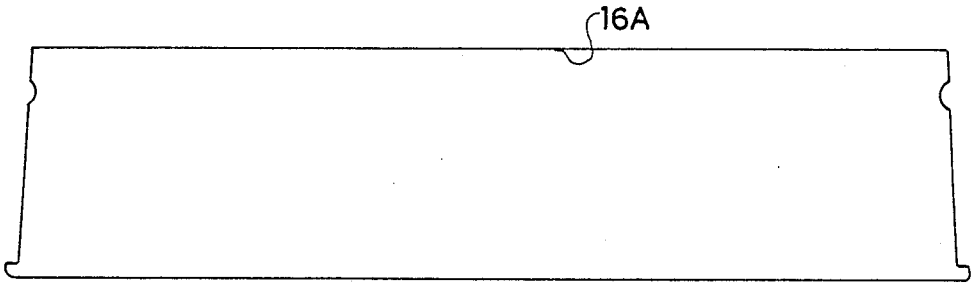
FIG. 2 is an end view of a slab with all of the hollow cores eliminated by the provision of stub augers at each hollow core location.

Reference to FIG. 2 will show a solid slab in which all of the forming or conventional augers have been removed and stub augers installed. This prevents the formation of any hollow cores and feeds the concrete mix in a consolidated manner over the entire core forming area and at the same time provides the motive power to move the machine along the rails so that the solid "no-core" slab is extruded there behind.

It will be appreciated that the stub augers basic purpose is to provide consistent and equal feed for the necessary volume of concrete or concrete like material throughout the moulding or forming chamber of machines used in the production of concrete products. This mechanism overcomes a problem common to these machines in that when placed in the proper location on the machine it ensures equal, consistent homogeneous and sufficient material being moved into the forming chamber with the result that the moulding or forming function is improved, and the finished, formed product is both structurally improved and each cross section is equal to and consistent with any other cross section produced.

It overcomes the problem of material starvation within the forming chamber of these machines wherein some sections have less material than others even though the process of extrusion is able to proceed.

The stub auger 29 may be used singly or in combination with other stub augers, or in combination with conventional augers 20 such as the "Ribbon" auger depending upon the desired cross sectional finished concrete product as illustrated in FIGS. 1, 2, 3 and 9.

The stub auger 29 is constructed as follows:

(A) The centre core mandrel 35 is in one piece in which the upstream end or first section 33 has its outer surfaces parallel to one another and the downstream end or second section 36 has its surfaces tapered down to approximately zero (as illustrated in FIG. 10);

(B) Attached to this shaped central core mandrel, there are flights wound throughout its length so that 1. in the first section 33 they are the same diameter and in the second section 36 i.e. the downstream end, the flight diameter constantly reduces to zero.
2. the pitch of these flights is consistent throughout the length of the entire stub auger even though the diameter of these flights nearest the downstream end are reducing.
3. the angle of the flights will be approximately 12° to 15°. The degree of this angle will vary dependent upon the concrete mix being used and its ability to be moulded varies from plant to plant and the material available in specific geographic areas. Therefore, by varying the angle of the flight, the stub auger can be manufactured to meet specific conditions in individual plants. When used with conventional augers this angle will correspond to the angle of flight of the conventional auger.

(C) The outside diameter of these flights and the length of the entire stub auger is dependent upon or calculated for the amount of concrete material which is needed to be placed within the cross section of the forming chamber.

(D) The taper of both the mandrel and the diameter of the flights begins at the same point towards the downstream end of the stub auger i.e., the beginning of the second section 36 of the entire stub auger (as in FIG. 10).

(E) The point towards the downstream end at which the taper of the core mandrel 35 and the flights 38 begins is dependent upon and is in relationship to:

1. The width of the opening of the hopper 19 which is directly above the stub auger mechanism and from which the concrete material flows vertically. This allows the stub auger flights to accept adequate concrete material and to move this material horizontally into the forming chamber, and
2. The size of the machine and the resulting finished concrete product. Extruders of 6", 8", 10" and 12" will require stub auger commensurate with the depth of the machine e.g. 6" machine will require 4" stub auger, and 8" machine will require 6" stub auger to adequately fill the mould or forming chamber, and
3. The position of or length of the hammering plate 26 which is immediately downstream from the hopper 19. The upstream portion of this hammering or vibrating plate is positioned directly above the downstream end of the stub auger (as in FIG. 4).

(F) The stub auger can either have a mounting flange 32 or a straight shaft for connecting it on to the drive mechanism which rotates the stub auger. Each method is dependent upon the product to be produced by the machine.

(G) The stub auger 29 must be manufactured in two models, one with right hand flights and the other with left hand flights so that the correct distribution of material can be obtained and to conform to the rotation of conventional augers.

The stub auger 29 is mounted on the production machine and rotated by its drive mechanism. Due to the nature of its construction or its configuration the precise or adequate concrete material is fed into the rotating flights 34 and 38 and is moved towards the downstream end 37 of the stub auger and the forming chamber between floor 17, hammer and travelling plates 26 and 27, and the conventional enclosing side plates (not illustrated).

Figure 12:
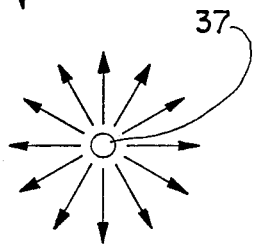
FIG. 12 is a schematic end view of the downstream end point of the stub auger showing the radially outward direction of the concrete caused by the stub auger.

Because of the rotation, the material is moved horizontally towards the forming chamber and because of the rotation the material is moved into the forming chamber in a radially outwards direction, thus filling the cavity of the forming chamber (as shown in FIGS. 10 and 12).

The taper of both the core mandrel 35 and the flights 38 in section 36 allow the material to be forced into and completely fill the total cross section of the moulding chamber, and at the same time and as a result of the tapered construction, avoids destroying the forming material in its cross section. Not only does the tapered section evenly distribute the concrete material towards the downstream end 37 of the stub auger but the auger when rotating removes itself from the preformed concrete material.

In the event that insufficient concrete material has not been placed at the beginning of the forming chamber, the stub auger's method of operation will ensure any inadequacy will be filled prior to compaction and consolidation of the finished concrete product.

When the proper density of concrete material has been formed uniformly throughout the cross section, the rotation of the stub auger will push the production machine away from the finished product and ensure a continuous process or extrusion of the desired concrete product.

The stub auger can be utilized in several different applications or machines depending upon the desired finished products.

1. Solid Concrete product e.g. solid floor roof and wall slabs

A plurality of stub augers replace the conventional auger hollowcore concrete floor slab extruders 20 and the resulting product will be a solid floor slab (as in FIG. #2) and, all stub augers will be parallel to each other.

It is of note that the same machine to produce hollowcore floor slab may be converted to produce solid floor slab simply by substituting stub augers for the conventional augers.

2. Method of Automatically filling one or more hollowcores in a conventional hollowcore slab In some hollowcore designs, it is required to fill one or more cores to achieve specific load criteria. The common method used to achieve this is to make several openings in the top side of the slab, while it is green, above a specific core and fill the opening with the slump mix.

This filled core then dries and shrinks (usually more than the surrounding slab because it is not compressed) and does nto bond with the surrounding slab material to form a solid section.

By using a stub auger in that specific core location, the void in the hollowcore is filled and the filled hole consolidates and "becomes one" with the rest of the extruded slab.

The use of the stub auger method of filling the cores ensures that the cross section is totally homogeneous with the result that the structural integrity of the slab is maintained.

When using a combination of conventional augers with the stub auger it should be noted that (a) the longitudinal axis of each auger must be parallel;

(b) the outside diameter of the stub auger is calculated to give the stub auger the same volume capacity as the conventional auger adjacent to it.

3. Large dimension floor slab with four conventional augers below and four stub augers above to produce slab with four rectangular vertical hollowcores As previously described, in the past several years, hollowcore technology has introduced new slabs with thicker dimensions (larger cross sectional area) to obtain a slab that can span longer lengths and carry larger load capacities for uses in parkades, large terminals and larger buildings. The building codes require a slab that is light, yet handles these extended spans and loads.

At the present time, there are some extruders that product 40 cm (16 inch) slabs with four cores using four conventional augers. The difficulty in this situation is that a large area above the conventional augers must be filled with concrete mix and pushed over the "hump" of the forming mandrel. Because of the limited volume of mix that a conventional auger can deliver, the concrete has a tendency to be pushed back over the auger and not over the forming mandrel. This causes starvation on the upper portion of the slab resulting in poor density and a lower load capacity.

This problem is solved when a stub auger is placed above the conventional auger. The stub auger has the capacity to fill the void in the upper portion of the slab and results in a even density and stronger slab.

4. To produce hollowcore slab with horizontal rectangular hollowcores

Figure 7:
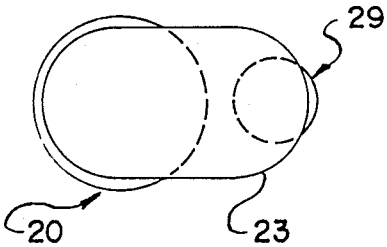
FIG. 7 is a schematic end view of a conventional auger, a follower tube and a stub auger situated to form a slab with horizontal substantially rectangular hollow cores.
Figure 8:
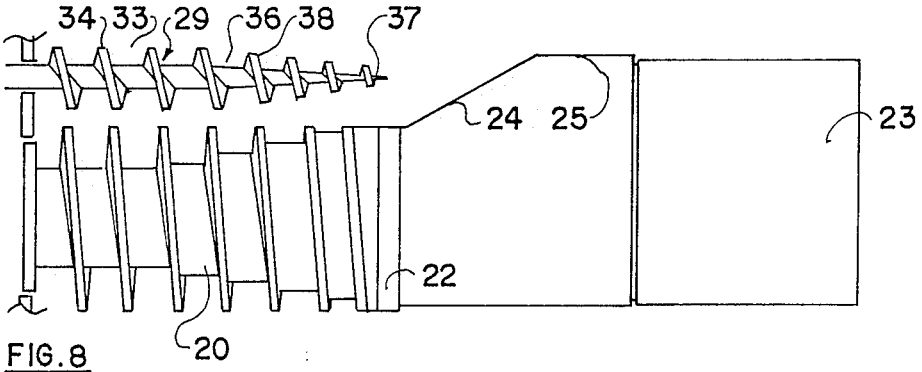
FIG. 8 is a schematic top plan view of FIG. 7.
Figure 9:
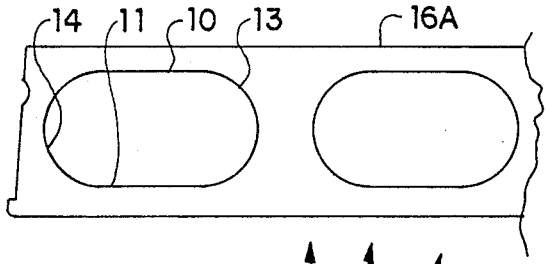
FIG. 9 is a fragmentary end view of a portion of a slab with the horizontally situated core.

As illustrated in FIG. 9 and the mechanism in FIGS. 7 and 8, it is possible to utilize this same mechanism to manufacture hollowcore slabs with horizontal rectangular hollowcores. The difference to item 3 above is that the relationship of stub auger to conventional auger is side by side rather than over and under.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. In a machine for the forming of reinforced cored concrete slabs which includes a hopper for feeding concrete by gravity into an auger chamber therebelow, a mold or forming chamber downstream of said hopper including a hammer plate and a trowelling plate, a plurality of rotatable main auger assemblies in horizontal and parallel relationship with one another extending under said hopper, a stationary forming mandrel and follower tube on the distal end of each main auger assembly and situated within the said molding chamber and a source of power for said main auger assemblies; wherein the improvement comprises at least one stub auger component below said hopper operatively rotatable by said source of power, said stub auger component including a shaft for mounting said stub auger for rotation by one end thereof upstream of said hopper and extending under said hopper and through said auger chamber, in horizontal relationship with the associated rotatable main auger assemblies and flighting secured to an extending around said shaft, said stub auger component having a first upstream portion including a shaft of substantially constant diameter and a second downstream portion in which said shaft gradually decreases in diameter from the adjacent end of said first upstream portion, said flighting of said first portion of said stub auger component having a substantially constant diameter, said flighting of said second portion of said stub auger component continuing from the adjacent end of the flighting around said portion of the shaft of said first portion but decreasing in diameter to substantially zero at the distal end of said shaft.

2. The invention according to claim 1 in which said stub auger component is situated immediately above said main auger assembly and spaced in horizontal relationship therewith.

3. The invention according to claim 1 in which said stub auger component is situated to one side of said main auger assembly in horizontal and parallel relationship therewith.

4. The invention according to claim 1 in which said stub auger component is substituted in place of at least one of said main auger assemblies to eliminate the formation of a core normally formed by the main auger assembly.

5. The invention according to claim 1 in which said stub auger component is provided with an attaching flange at the other end of said shaft of said first portion thereof.

6. The invention according to claim 2 in which said stub auger component is provided with an attaching flange at the other end of said shaft of said first portion thereof.

7. The invention according to claim 3 in which said stub auger component is provided with an attaching flange at the other end of said shaft of said first portion thereof.

8. The invention according to claim 4 in which said stub auger component is provided with an attaching flange at the other end of said shaft of said first portion thereof.

9. The invention according to claim 1 in which the forming tube or mandrel of the main auger assemblies includes a pair of vertical parallel sides, an arcuately curved convex base and an upper surface, said upper surface including an upstream portion extending from the downstream end of said main auger assembly, upwardly and forwardly thereof thereby forming a ramp for controlling the direction and movement of concrete passing thereover, and a downstream horizontal upper surface extending downstream from the upper forward end of the upwardly and forwardly extending ramp, said stub auger component being situated upstream of said ramp and terminating adjacent a junction between the main auger assembly and said forming mandrel, the upper side of said stub auger component being substantially level with the horizontal upper surface of said forming mandrel.

10. The invention according to claim 2 in which the forming tube or mandrel of the main auger assemblies includes a pair of vertical parallel sides, an arcuately curved convex base and an upper surface, said upper surface including an upstream portion extending from the downstream end of said main auger assembly, upwardly and forwardly thereof thereby forming a ramp for controlling the direction and movement of concrete passing thereover, and a downstream horizontal upper surface extending downstream from the upper forward end of the upwardly and forwardly extending ramp, said stub auger component being situated upstream of said ramp and terminating adjacent a junction between the main auger assembly and said forming mandrel, the upper side of said stub auger component being substantially level with the horizontal upper surface of said forming mandrel.

11. The invention according to claim 3 in which the forming tube or mandrel of the main auger assemblies includes a pair of vertical parallel sides, an arcuately curved convex base and an upper surface, said upper surface including an upstream portion extending from the downstream end of said main auger assembly, upwardly and forwardly thereof thereby forming a ramp for controlling the direction and movement of concrete passing thereover, and a downstream horizontal upper surface extending downstream from the upper forward end of the upwardly and forwardly extending ramp, said stub auger component being situated upstream of said ramp and terminating adjacent a junction between the main auger assembly and said forming mandrel, the upper side of said stub auger component being substantially level with the horizontal upper surface of said forming mandrel.

12. The invention according to claim 4 in which the forming tube or mandrel of the main auger assemblies includes a pair of vertical parallel sides, an arcuately curved convex base and an upper surface, said upper surface including an upstream portion extending from the downstream end of said main auger assembly, upwardly and forwardly thereof thereby forming a ramp for controlling the direction and movement of concrete passing thereover, and a downstream horizontal upper surface extending downstream from the upper forward end of the upwardly and forwardly extending ramp, said stub auger component being situated upstream of said ramp and terminating adjacent a junction between the main auger assembly and said forming mandrel, the upper side of said stub auger component being substantially level with the horizontal upper surface of said forming mandrel.

13. The invention according to claim 1 in which the pitch of said stub auger component is constant from one end to the other end of said shaft.

14. A machine for forming reinforced cored concrete slabs said machine comprising in combination a hopper for feeding concrete by gravity into an auger chamber therebelow, a mold or forming chamber downstream of said hopper including a hammer plate and a trowelling plate, a plurality of rotatable main auger assemblies in horizontal and parallel relationship with one another extending under said hopper, a stationary forming mandrel and follower tube on the distal end of each main auger assembly and situated within said molding chamber and a source of power for said main auger assemblies, a stub auger component situated below said hopper and operatively rotatable by said source or power, said stub auger component including a shaft for mounting said stub auger component for rotation by one end thereof upstream of said hopper and extending under said hopper and through said auger chamber, in horizontal relationship with the associated rotatable main auger assemblies and flighting secured to and extending around said shaft, said stub auger component having a first upstream portion including a shaft of substantially constant diameter and a second downstream portion in which said shaft gradually decreases in diameter from the adjacent end of said first upstream portion, said flighting of said first portion of said stub auger component having a substantially constant diameter, said flighting of said second portion of said stub auger component continuing from the adjacent end of the flighting around said portion of the shaft of said first portion but decreasing in diameter to substantially zero at the distal end of said shaft.

15. The invention according to claim 14 in which said stub auger component is provided with an attaching flange at the other end of said shaft of said first portion thereof.

16. The invention according to claim 14 in which said stub auger component is provided with a connecting drive shaft portion extending from the other end of said shaft of said first portion thereof.

17. The invention according to claim 14 in which the pitch to the other end of said shaft and the angle of inclination of the flight of said stub auger component is approximately 12° to 15° from the vertical axis of said shaft.

18. The invention according to claim 15 in which the pitch of said stub auger component is constant from one end to the other end of said shaft and the angle of inclination of the flight of said stub auger component is approximately 12° to 15° from the vertical axis of said shaft.

19. The invention according to claim 16 in which the pitch of said stub auger component is constant from one end to the other end of said shaft and the angle of inclination of the flight of said stub auger component is approximately 12° to 15° from the vertical axis of said shaft.

* * * * *